US005103698A

United States Patent [19]

Delaney

[11] Patent Number: 5,103,698

[45] Date of Patent: Apr. 14, 1992

[54] TOOL FOR INSTALLING BASIN DRAIN BASKET

[76] Inventor: Edwin Delaney, 307 Jamestown Rd., South Charleston, Ohio 45368

[21] Appl. No.: 726,397

[22] Filed: Jul. 5, 1991

[51] Int. Cl.[5] ..... B25B 23/00

[52] U.S. Cl. ..... 81/461; 81/13; 81/451

[58] Field of Search ..... 81/461, 451, 13, 488

[56] References Cited

U.S. PATENT DOCUMENTS

| | | | |
|---|---|---|---|
| 1,129,049 | 2/1915 | Smith | 81/461 |
| 2,384,525 | 9/1945 | Beverly | 81/451 |
| 2,602,356 | 7/1952 | Wanamaker | 81/13 |
| 2,605,664 | 8/1952 | Galbraith | 81/461 |
| 2,619,861 | 12/1952 | Wanamaker | 81/461 |
| 2,956,461 | 10/1960 | Anderson | 81/461 |

*Primary Examiner*—Mark Rosenbaum
*Assistant Examiner*—Hwei-Siu Payer
*Attorney, Agent, or Firm*—Joseph G. Nauman

[57] ABSTRACT

A tool for use in attachment of a drain basket to a drain hole in a basin or the like, is provided in the form of a cylindrical body having lugs projecting longitudinally from one end thereof. The drain basket has a lower cup-like portion with a plurality of drain apertures and a threaded portion on the exterior of the cup-like portion for attachment to a drain pipe, the cup-like portion receiving therein a strainer basket for retaining particles from water flowing from the basin to a drain pipe. The lugs of the tool are shaped and dimensioned to fit into the drain apertures near the bottom of the cup. Around the base or joint of the lugs with the tool body, there is a radially extending ring or ledge. The tool may be attached to the external bottom of the drain basket by inserting the lugs through the cup-like portion and into the slots, then applying the lower flange around the tool body and threading it onto the lower threaded fitting which extends down from the cup.

5 Claims, 1 Drawing Sheet

FIG-1
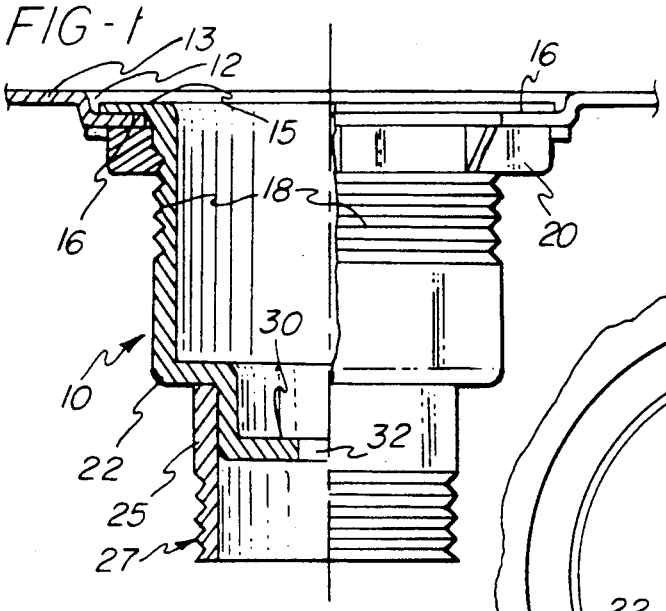
FIG-2
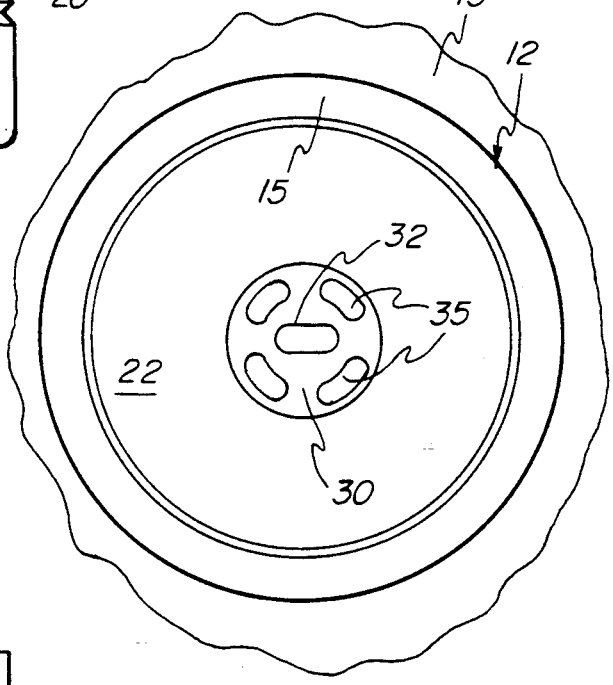
FIG-3
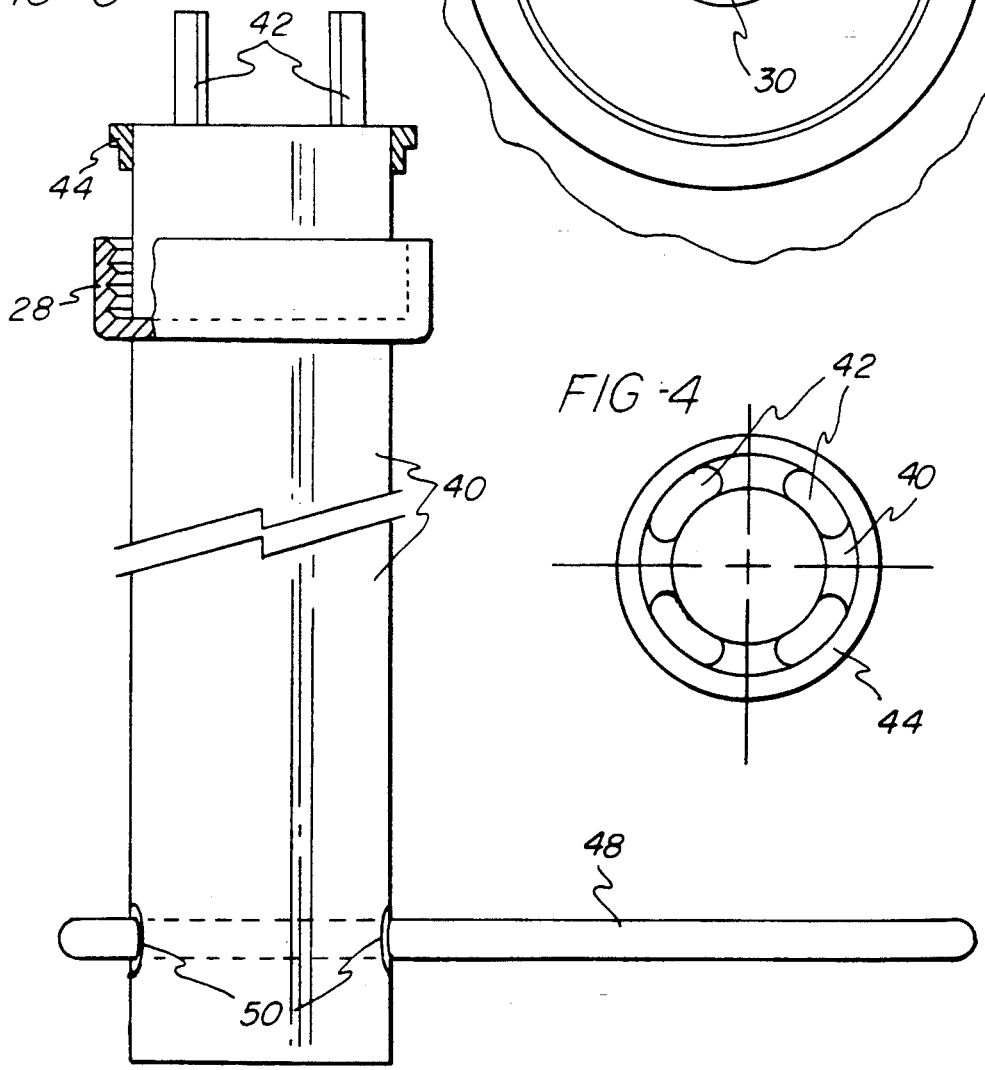
FIG-4

TOOL FOR INSTALLING BASIN DRAIN BASKET

This invention relates to a specialized tool useful for installing a drain basket in a basin, such a kitchen or lavatory sink.

A drain basket comprises a fitting which is attached to a drain hole or opening in the bottom of a basin, having a flange which rests on the inner bottom of the basin surrounding the drain hole, usually with a gasket underneath the flange. The basket is provided with and external threaded or equivalent upper fitting, immediately below the upper flange, which receives a cooperating ring that, upon tightening, presses the basket and the upper flange together forming a sealed connection from the basin. Below the flange, the basin has an integral cup-like configuration which provides a receptacle for a similarly shaped removable strainer.

The strainer has a solid bottom and plurality of slots or holes in its sides above its bottom, through which water may flow into the cup, and a lower gasket (below the slots) which can interact with the lower central part of the cup to function as a stopper. The discharge from the cup is through a reduced cylindrical lower fitting extending downward from the cup, and having a threaded end which receives a nut to retain the drain pipe to the lower fitting. In that lower fitting there is a cross-piece having a central slot, which receives an end of a shaft installation extending downward from the strainer, and a plurality (usually four) of surrounding slots or drain apertures.

At present, the plumber is required, at some point in such an installation, to hold a lower fitting of the drain basket with a wrench, and avoid damaging its threads, while tightening the ring to the upper fitting. Once that is accomplished, the drain basket is fastened to the bottom of the basin, and the rest of the plumbing installation can proceed. The problem is to reach that point in the using only two hands and being careful not to damage any part of the drain basket assembly in doing so.

SUMMARY OF THE INVENTION

The present invention provides a tool in the form of a cylindrical body having lugs projecting longitudinally from one end thereof, the lugs being shaped and dimensioned to fit into the surrounding slots in the cross-piece near the bottom of the cup. Around the base or joint of the lugs with the tool body, there is a radially extending ring or ledge. The tool may be attached to the external bottom of the drain basket by inserting the lugs into the slots, then applying the lower flange around the tool body and threading it onto the lower threaded fitting which extends down from the cup. This may easily be accomplished by hand tightening.

The assembled tool and drain basket may then be lowered into the basin and through the drain hole, with the gasket in place. Then, the upper ring is placed around the tool and basket cup, and threaded onto the upper fitting of the basket. With this accomplished, the installer may extend a rod or thin blade through aligned holes in the bottom of the tool body, hold the tool and basket against rotation, and easily apply a spanner or similar tool to tighten the upper flange. Then, the lower flange may be removed from the tool, the tool taken from the basket, and the drain tube attached to the lower fitting in the conventional fashion.

BRIEF DESCRIPTION OF THE DRAWINGS

FIG. 1 is a side view of a typical drain basket, shown partly in cross-section;

FIG. 2 is a plan view of the upper end of the basket and a small area of the surrounding basin;

FIG. 3 illustrates the tool of the invention, aligned with the typical drain basket shown in FIG. 1;

FIG. 4 is an upper end view of the tool.

DESCRIPTION OF THE PREFERRED EMBODIMENT

A drain basket 10 comprises a fitting which is attached to a drain hole or opening 12 in the bottom of a basin 13. Only a small segment of the basin is shown, illustrating the drain opening receiving a flange 15 of the basket, which rests on the inner bottom of the basin surrounding drain hole 12, usually with a gasket or a ring of caulk 16 underneath the flange. The basket is provided with and external threaded or equivalent upper fitting 18, immediately below flange 15, for receiving a cooperating ring 20 that, upon tightening, presses basket 10 against the basin drain opening, which together forming a sealed connection to the basin. Below flange 15, the basin has an integral cup-like configuration 22 which provides a receptacle for a similarly shaped conventional removable strainer (not shown).

As is known, the strainer typically has a solid bottom and plurality of slots or holes in its sides above its bottom, through which water may flow into the basket, and a lower gasket below the drain slots which can interact with the lower central part of cup 22 to function as a stopper. The discharge from the cup is through a reduced cylindrical lower fitting 25 extending downward from cup 22, and having a threaded end 27 which receives a nut 28 to retain the drain pipe to the lower fitting. In that lower fitting there is a cross-piece 30 having a central slot 32, which receives an end of a flat tang extending downward from the strainer, and a plurality (usually four) of surrounding slots or apertures 35. Thereby, the strainer can be used as a stopper within basket 10, or can be held above the bottom of cup 22 to function as a strainer to flow therethrough.

The tool for handling and holding the drain basket is in the form of a cylindrical body 40 having lugs 42 projecting longitudinally from one end thereof, the lugs being shaped and dimensioned to fit into the surrounding slots 35 in cross-piece 30 near the bottom of cup 22. Around the base or joint of the lugs with the tool body, there is a radially extending ring or ledge 44, which may be integral with the tool body or press-fit thereto.

The tool may be attached to the external bottom of the drain basket by inserting lugs 42 into slots 35, then applying the nut 28 around the tool body and threading it onto the lower threaded fitting 25, which extends down from the cup. This may easily be accomplished by hand tightening.

The assembled tool and drain basket may then be lowered into the basin and through the drain hole, with the gasket or caulk in place. Then, upper ring 20 is placed around the tool and basket cup, and threaded onto upper fitting 18 of the basket. With this accomplished, the installer may extend a rod or thin blade 48 through aligned holes 50 near the bottom of the tool body, hold the tool and basket against rotation, and easily apply a spanner or similar tool to tighten upper flange 20. Then, nut 28 may be removed from the tool, the tool taken from the basket, and the drain tube attached to lower fitting 25 in conventional fashion, using nut 28.

While the form of apparatus herein described constitute a preferred embodiment of this invention, it is to be understood that the invention is not limited to this precise form of apparatus, and that changes may be made therein departing from the scope of the invention which is defined in the appended claims.

What is claimed is:

1. A tool for use in the installation of a drain basket into a drain hole in a sink basin, said basket having a flange for fitting against the inside bottom of the basin surrounding the drain hole and having means cooperating with the flange to engage the basin around the drain hole and clamp said basket thereto extending through the drain hole, said basket also having a lower cup-like portion beyond said flange with a plurality of drain apertures and a threaded portion on the exterior of the cup-like portion for attachment to a drain pipe, said cup-like portion being adapted to receive therein a strainer basket for retaining particles from water flowing from the basin to such drain pipe; said tool comprising a cylindrical main body, a plurality of lugs joined to said main body and extending longitudinally from one end of said main body, said lugs being dimensioned to engage within at least some of the drain apertures.

a tool retaining ring on said main body adjacent the joint of said lugs and said main body and having a radially outward extending flange, whereby said lugs can be inserted through the drain apertures and said tool can be temporarily attached to said basket by a threaded drain pipe flange surrounding the tool and fitted over said retaining ring flange and threaded to the threaded portion on the basket, and means for resisting rotation of said main body while the basket clamping means is tightened against the exterior of the basin around the drain hole.

2. A tool as defined in claim 1, said means for resisting rotation further comprising means forming a pair of apertures aligned transversely of said main body spaced longitudinally thereof from said retaining ring to receive a rod-like tool for resisting rotation of said main body.

3. A tool as defined in claim 1, wherein said lugs are integrally formed with said one end of said main body.

4. A tool as defined in claim 3, wherein said tool retaining ring is press fitted to said main body.

5. A tool for installation of a drain basket into a drain hole in a sink basin, said basket having a flange for fitting against the inside bottom of the basin surrounding the drain hole and having a first threaded region adjacent the flange and a basket retaining ring threaded onto the first region to engage the underside of the basin around the drain hole and clamp the flange to the basin extending through the drain hole, said basket also having a lower cup-like portion beyond the first threaded region with a plurality of drain apertures and a second threaded portion on the exterior of the cup-like portion for attachment to a drain pipe, said cup-like portion being adapted to receive therein a strainer basket for retaining particles from water flowing from the basin to such drain pipe; said tool comprising a cylindrical main body, a plurality of lugs joined to said main body and extending longitudinally from one end of said main body, said lugs being dimensioned to fit into said cup-like portion and to engage within at least some of the drain apertures, a tool retaining ring on the exterior of said main body adjacent the joint of said lugs and said main body and having a radially outward extending flange, whereby said lugs can be inserted into the cup-like portion and through the drain apertures and said tool can be temporarily attached to the basket by a threaded drain pipe flange surrounding the tool, fitted over the retaining ring flange, and threaded to the second threaded portion on the basket, and means for resisting rotation of said main body while the basket retaining ring is tightened against the exterior of the basin around the drain hole.

* * * * *